US007014538B2

(12) United States Patent
Tietz et al.

(10) Patent No.: US 7,014,538 B2
(45) Date of Patent: Mar. 21, 2006

(54) ARTICLE FOR POLISHING SEMICONDUCTOR SUBSTRATES

(75) Inventors: James V. Tietz, Fremont, CA (US); Shijian Li, San Jose, CA (US); Manoocher Birang, Los Gatos, CA (US); John M. White, Hayward, CA (US); Lawrence M. Rosenberg, deceased, late of San Jose, CA (US); by Sandra L. Rosenberg, legal representative, San Jose, CA (US); Marty Scales, San Jose, CA (US); Ramin Emami, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/382,079

(22) Filed: Mar. 5, 2003

(65) Prior Publication Data

US 2004/0082288 A1 Apr. 29, 2004

Related U.S. Application Data

(63) Continuation of application No. 09/563,628, filed on May 2, 2000, now abandoned.

(60) Provisional application No. 60/132,175, filed on May 3, 1999.

(51) Int. Cl.
*B24D 11/00* (2006.01)

(52) U.S. Cl. ..... 451/56; 451/533

(58) Field of Classification Search ..... 451/56, 451/57, 526–539; 51/293, 295, 298, 307–309; 428/323, 327–331, 403

See application file for complete search history.

(56) References Cited

U.S. PATENT DOCUMENTS

| | | | |
|---|---|---|---|
| 1,601,642 | A | 9/1926 | Parker |
| 1,927,162 | A | 9/1933 | Fiedler et al. |
| 2,112,691 | A | 3/1938 | Crowder |
| 2,240,265 | A | 4/1941 | Nachtman |
| 2,392,687 | A | 1/1946 | Nachtman |
| 2,431,065 | A | 11/1947 | Miller |

(Continued)

FOREIGN PATENT DOCUMENTS

| | | |
|---|---|---|
| EP | 0 325 753 | 8/1989 |

(Continued)

OTHER PUBLICATIONS

Contolini, "Electrochemical Planarization of ULSI Copper," Solid State Technology, vol. 40, No. 6, Jun. 1, 1997.

(Continued)

*Primary Examiner*—David B. Thomas
(74) *Attorney, Agent, or Firm*—Patterson & Sheridan

(57) ABSTRACT

A method and apparatus for using fixed abrasive polishing pads that contain posts for chemical mechanical polishing (CMP). The posts have different shapes, different sizes, different heights, different materials, different distribution of abrasive particles and different process chemicals. This invention also includes preconditioning fixed abrasive articles comprising a plurality of posts so that the posts have equal heights above the backing to achieve a uniform texture. This invention relates to improvements with respect to in situ rate measurement (ISRM) devices. The invention resides in providing a mechanical means, such as a notch, to determine when approaching the end of the abrasive web roll. The invention resides in coding the web throughout its length to enable determining the location of different portions of the web. This invention resides in providing perforations in the sides or end of the web for improved handling.

32 Claims, 8 Drawing Sheets

U.S. PATENT DOCUMENTS

| | | | | | |
|---|---|---|---|---|---|
| 2,451,341 | A | | 10/1948 | Jemstedt | |
| 2,453,481 | A | | 11/1948 | Wilson | |
| 2,454,935 | A | | 11/1948 | Miller | |
| 2,456,185 | A | | 12/1948 | Grube | |
| 2,457,510 | A | | 12/1948 | van Omum | |
| 2,458,676 | A | | 1/1949 | Brenner et al. | |
| 2,461,556 | A | | 2/1949 | Lorig | |
| 2,473,290 | A | | 6/1949 | Millard | |
| 2,477,808 | A | | 8/1949 | Jones | |
| 2,479,323 | A | | 8/1949 | Davis | |
| 2,480,022 | A | | 8/1949 | Hogaboom | |
| 2,490,055 | A | | 12/1949 | Hoff | |
| 2,495,695 | A | | 1/1950 | Camin et al. | |
| 2,500,205 | A | | 3/1950 | Schaefer | |
| 2,500,206 | A | | 3/1950 | Schaefer et al. | |
| 2,503,863 | A | | 4/1950 | Bart | |
| 2,506,794 | A | | 5/1950 | Kennedy et al. | |
| 2,509,304 | A | | 5/1950 | Klein | |
| 2,512,328 | A | | 6/1950 | Hays | |
| 2,517,907 | A | | 8/1950 | Mikulas | |
| 2,519,945 | A | | 8/1950 | Twele et al. | |
| 2,530,677 | A | | 11/1950 | Berkenkotter et al. | |
| 2,535,966 | A | | 12/1950 | Teplitz | |
| 2,536,912 | A | | 1/1951 | Cobertt | |
| 2,539,898 | A | | 1/1951 | Davis | |
| 2,540,175 | A | | 2/1951 | Rosenqvist | |
| 2,544,510 | A | | 3/1951 | Prahl | |
| 2,549,678 | A | | 4/1951 | Flandt | |
| 2,554,943 | A | | 5/1951 | Farmer | |
| 2,556,017 | A | | 6/1951 | Vonada | |
| 2,560,534 | A | | 7/1951 | Adler | |
| 2,560,966 | A | | 7/1951 | Lee | |
| 2,569,577 | A | | 10/1951 | Reading | |
| 2,569,578 | A | | 10/1951 | Rieger | |
| 2,571,709 | A | | 10/1951 | Gray | |
| 2,576,074 | A | | 11/1951 | Nachtman | |
| 2,587,630 | A | | 3/1952 | Konrad et al. | |
| 2,619,454 | A | | 11/1952 | Zapponi | |
| 2,633,452 | A | | 3/1953 | Hogaboom, Jr. et al. | |
| 2,646,398 | A | | 7/1953 | Henderson | |
| 2,656,283 | A | | 10/1953 | Fink et al. | |
| 2,656,284 | A | | 10/1953 | Toulmin | |
| 2,657,177 | A | | 10/1953 | Rendel | |
| 2,657,457 | A | | 11/1953 | Toulmin | |
| 2,673,836 | A | | 3/1954 | Vonada | |
| 2,674,550 | A | | 4/1954 | Dunlevy et al. | |
| 2,675,348 | A | | 4/1954 | Greenspan | |
| 2,680,710 | A | | 6/1954 | Kenmore et al. | |
| 2,684,939 | A | | 7/1954 | Geese | |
| 2,686,859 | A | | 8/1954 | Gray et al. | |
| 2,689,215 | A | | 9/1954 | Bart | |
| 2,695,269 | A | | 11/1954 | de Witz et al. | |
| 2,698,832 | A | | 1/1955 | Swanson | |
| 2,706,173 | A | | 4/1955 | Wells et al. | |
| 2,706,175 | A | | 4/1955 | Licharz | |
| 2,708,445 | A | | 5/1955 | Manson et al. | |
| 2,710,834 | A | | 6/1955 | Vrilakas | |
| 2,711,993 | A | | 6/1955 | Lyon | |
| 3,162,588 | A | | 12/1964 | Bell | |
| 3,334,041 | A | * | 8/1967 | Dyer et al. | 204/284 |
| 3,433,730 | A | | 3/1969 | Kennedy et al. | |
| 3,448,023 | A | | 6/1969 | Bell | |
| 3,476,677 | A | | 11/1969 | Corley et al. | |
| 3,607,707 | A | | 9/1971 | Chenevier | |
| 3,873,512 | A | | 3/1975 | Latanision | |
| 3,942,959 | A | * | 3/1976 | Markoo et al. | 51/295 |
| 3,992,178 | A | * | 11/1976 | Markoo et al. | 51/295 |
| 4,047,902 | A | | 9/1977 | Wiand et al. | |
| 4,082,638 | A | | 4/1978 | Jumer | |
| 4,119,515 | A | | 10/1978 | Costakis | |
| 4,125,444 | A | | 11/1978 | Inoue | |
| 4,312,716 | A | | 1/1982 | Maschler et al. | |
| 4,523,411 | A | | 6/1985 | Freerks | |
| 4,704,511 | A | | 11/1987 | Miyano | |
| 4,713,149 | A | | 12/1987 | Hoshino | |
| 4,752,371 | A | | 6/1988 | Kreisel et al. | |
| 4,772,361 | A | | 9/1988 | Dorsett et al. | |
| 4,793,895 | A | | 12/1988 | Kaanta et al. | |
| 4,839,993 | A | | 6/1989 | Masuko et al. | |
| 4,934,102 | A | | 6/1990 | Leach et al. | |
| 4,954,141 | A | | 9/1990 | Takiyama et al. | |
| 4,956,056 | A | | 9/1990 | Zubatova et al. | |
| 5,011,510 | A | | 4/1991 | Hayakawa et al. | |
| 5,014,468 | A | | 5/1991 | Ravipati et al. | |
| 5,061,294 | A | * | 10/1991 | Harmer et al. | 51/295 |
| 5,066,370 | A | | 11/1991 | Andreshak et al. | |
| 5,096,550 | A | | 3/1992 | Mayer et al. | |
| 5,108,463 | A | * | 4/1992 | Buchanan | 51/295 |
| 5,136,817 | A | | 8/1992 | Tabata et al. | |
| 5,137,542 | A | | 8/1992 | Buchanan et al. | |
| 5,152,917 | A | | 10/1992 | Pieper et al. | |
| 5,203,884 | A | * | 4/1993 | Buchanan et al. | 51/295 |
| 5,217,586 | A | | 6/1993 | Datta et al. | |
| 5,225,034 | A | | 7/1993 | Yu et al. | |
| 5,257,478 | A | | 11/1993 | Hyde et al. | |
| 5,328,716 | A | | 7/1994 | Buchanan | |
| 5,437,754 | A | | 8/1995 | Calhoun | |
| 5,453,312 | A | | 9/1995 | Haas et al. | |
| 5,454,844 | A | | 10/1995 | Hibbard et al. | |
| 5,472,371 | A | | 12/1995 | Yamakura et al. | |
| 5,478,435 | A | | 12/1995 | Murphy et al. | |
| 5,527,424 | A | | 6/1996 | Mullins | |
| 5,534,106 | A | | 7/1996 | Cote et al. | |
| 5,543,032 | A | | 8/1996 | Datta et al. | |
| 5,560,753 | A | | 10/1996 | Schnabel et al. | |
| 5,562,529 | A | | 10/1996 | Kishii et al. | |
| 5,567,300 | A | | 10/1996 | Datta et al. | |
| 5,575,706 | A | | 11/1996 | Tsai et al. | |
| 5,578,362 | A | | 11/1996 | Reinhardt et al. | |
| 5,595,527 | A | | 1/1997 | Appel et al. | |
| 5,605,760 | A | | 2/1997 | Roberts | |
| 5,624,300 | A | | 4/1997 | Kishii et al. | |
| 5,633,068 | A | | 5/1997 | Ryoke et al. | |
| 5,654,078 | A | | 8/1997 | Ferronato | |
| 5,674,122 | A | | 10/1997 | Krech | |
| 5,692,950 | A | | 12/1997 | Rutherford et al. | |
| 5,702,811 | A | * | 12/1997 | Ho et al. | 428/323 |
| 5,725,417 | A | | 3/1998 | Robinson | |
| 5,738,574 | A | | 4/1998 | Tolles et al. | |
| 5,743,784 | A | | 4/1998 | Birang et al. | |
| 5,779,521 | A | | 7/1998 | Muroyama et al. | |
| 5,804,507 | A | | 9/1998 | Perlov et al. | |
| 5,807,165 | A | | 9/1998 | Uzoh et al. | |
| 5,810,964 | A | | 9/1998 | Shiraishi | |
| 5,820,450 | A | | 10/1998 | Calhoun | |
| 5,823,854 | A | | 10/1998 | Chen | |
| 5,823,855 | A | | 10/1998 | Robinson | |
| 5,840,190 | A | | 11/1998 | Scholander et al. | |
| 5,840,629 | A | | 11/1998 | Carpio | |
| 5,842,910 | A | | 12/1998 | Krywanczyk et al. | |
| 5,846,882 | A | | 12/1998 | Birang | |
| 5,868,605 | A | | 2/1999 | Cesna | |
| 5,871,392 | A | | 2/1999 | Meikle et al. | |
| 5,882,491 | A | | 3/1999 | Wardle | |
| 5,893,796 | A | | 4/1999 | Birang et al. | |
| 5,899,745 | A | | 5/1999 | Kim et al. | |
| 5,904,615 | A | | 5/1999 | Jeong et al. | |
| 5,911,619 | A | | 6/1999 | Uzoh et al. | |
| 5,913,713 | A | | 6/1999 | Cheek et al. | |
| 5,916,010 | A | | 6/1999 | Varian et al. | |
| 5,938,801 | A | | 8/1999 | Robinson | |
| 5,944,583 | A | | 8/1999 | Cruz et al. | |
| 5,948,697 | A | | 9/1999 | Hata | |
| 5,951,380 | A | | 9/1999 | Kim | |

| | | | | |
|---|---|---|---|---|
| 5,958,794 | A | | 9/1999 | Bruxvoort et al. |
| 5,985,090 | A | | 11/1999 | Kikuta et al. |
| 5,985,093 | A | | 11/1999 | Chen |
| 6,001,008 | A | | 12/1999 | Fujimori et al. |
| 6,004,880 | A | | 12/1999 | Liu et al. |
| 6,012,968 | A | | 1/2000 | Lofaro |
| 6,017,265 | A | | 1/2000 | Cook et al. |
| 6,020,264 | A | | 2/2000 | Lustig et al. |
| 6,022,264 | A | | 2/2000 | Cook et al. |
| 6,024,630 | A | | 2/2000 | Shendon et al. |
| 6,033,293 | A | | 3/2000 | Crevasse et al. |
| 6,056,851 | A | | 5/2000 | Hsich et al. |
| 6,066,030 | A | | 5/2000 | Uzoh |
| 6,069,080 | A | | 5/2000 | James et al. |
| 6,074,284 | A | * | 6/2000 | Tani et al. ..... 451/57 |
| 6,077,337 | A | | 6/2000 | Lee |
| 6,080,215 | A | | 6/2000 | Stubbs et al. |
| 6,090,239 | A | | 7/2000 | Liu et al. |
| 6,093,085 | A | | 7/2000 | Yellitz et al. |
| 6,103,096 | A | | 8/2000 | Datta et al. |
| 6,106,382 | A | | 8/2000 | Sakaguchi |
| 6,106,661 | A | | 8/2000 | Raeder et al. |
| 6,116,998 | A | | 9/2000 | Damgaard et al. |
| 6,120,349 | A | | 9/2000 | Nyui et al. |
| 6,121,143 | A | | 9/2000 | Messner et al. |
| 6,132,292 | A | | 10/2000 | Kubo |
| 6,136,043 | A | | 10/2000 | Robinson et al. |
| 6,153,043 | A | | 11/2000 | Edelstein et al. |
| 6,156,124 | A | | 12/2000 | Tobin et al. |
| 6,159,079 | A | | 12/2000 | Zuniga et al. |
| 6,168,508 | B1 | | 1/2001 | Nagahara et al. |
| 6,171,467 | B1 | | 1/2001 | Weihs et al. |
| 6,176,992 | B1 | | 1/2001 | Talieh |
| 6,176,998 | B1 | | 1/2001 | Wardle et al. |
| 6,183,354 | B1 | | 2/2001 | Zuniga et al. |
| 6,190,494 | B1 | | 2/2001 | Dow |
| 6,197,692 | B1 | | 3/2001 | Fushimi |
| 6,210,257 | B1 | | 4/2001 | Carlson |
| 6,234,870 | B1 | | 5/2001 | Uzoh et al. |
| 6,238,271 | B1 | | 5/2001 | Cesna |
| 6,238,592 | B1 | | 5/2001 | Hardy et al. |
| 6,241,583 | B1 | | 6/2001 | White |
| 6,244,935 | B1 | | 6/2001 | Birang et al. |
| 6,248,222 | B1 | | 6/2001 | Wang |
| 6,251,235 | B1 | | 6/2001 | Talieh et al. |
| 6,257,953 | B1 | | 7/2001 | Gitis et al. |
| 6,258,223 | B1 | | 7/2001 | Cheung et al. |
| 6,261,168 | B1 | | 7/2001 | Jensen et al. |
| 6,261,959 | B1 | | 7/2001 | Travis et al. |
| 6,264,533 | B1 | | 7/2001 | Kummeth et al. |
| 6,273,798 | B1 | | 8/2001 | Berman |
| 6,296,557 | B1 | | 10/2001 | Walker |
| 6,297,159 | B1 | | 10/2001 | Paton |
| 6,319,108 | B1 | | 11/2001 | Adefris et al. |
| 6,319,420 | B1 | | 11/2001 | Dow |
| 6,322,422 | B1 | | 11/2001 | Satou |
| 6,328,642 | B1 | | 12/2001 | Pant et al. |
| 6,328,872 | B1 | | 12/2001 | Talieh et al. |
| 6,331,135 | B1 | | 12/2001 | Sabde et al. |
| 6,368,184 | B1 | | 4/2002 | Beckage |
| 6,368,190 | B1 | | 4/2002 | Easter et al. |
| 6,372,001 | B1 | | 4/2002 | Omar et al. |
| 6,381,169 | B1 | | 4/2002 | Bocian et al. |
| 6,383,066 | B1 | | 5/2002 | Chen et al. |
| 6,386,956 | B1 | | 5/2002 | Sato et al. |
| 6,391,166 | B1 | | 5/2002 | Wang |
| 6,395,152 | B1 | | 5/2002 | Wang |
| 6,402,591 | B1 | | 6/2002 | Thornton |
| 6,406,363 | B1 | | 6/2002 | Xu et al. |
| 6,409,904 | B1 | | 6/2002 | Uzoh et al. |
| 6,431,968 | B1 | | 8/2002 | Chen et al. |
| 6,440,295 | B1 | | 8/2002 | Wang |
| 6,447,668 | B1 | | 9/2002 | Wang |
| 6,471,847 | B1 | | 10/2002 | Talieh et al. |
| 6,537,140 | B1 | | 3/2003 | Miller et al. |
| 6,641,471 | B1 | | 11/2003 | Pinheiro et al. |
| 6,769,969 | B1 | | 8/2004 | Duescher |
| 2001/0005667 | A1 | | 6/2001 | Tolles et al. |
| 2001/0027018 | A1 | | 10/2001 | Molnar |
| 2001/0040100 | A1 | | 11/2001 | Wang |
| 2001/0042690 | A1 | | 11/2001 | Talieh |
| 2002/0008036 | A1 | | 1/2002 | Wang |
| 2002/0011417 | A1 | | 1/2002 | Talieh et al. |
| 2002/0088715 | A1 | | 7/2002 | Talieh et al. |
| 2003/0013397 | A1 | | 1/2003 | Rhoades |

FOREIGN PATENT DOCUMENTS

| | | | |
|---|---|---|---|
| EP | 0 451 572 | A | 10/1991 |
| EP | 0 455 455 | | 11/1991 |
| EP | 0 999 013 | | 5/2000 |
| GB | 2 345 657 | A | 7/2000 |
| JP | 58-171264 | | 10/1983 |
| JP | 06-079666 | | 4/1986 |
| JP | 61-265279 | | 11/1986 |
| JP | 61265279 | A * | 11/1986 |
| JP | 05-277957 | | 10/1993 |
| JP | 05277957 | A * | 10/1993 |
| JP | 06-047678 | | 2/1994 |
| JP | 10-06213 | | 1/1998 |
| JP | 63-028512 | | 2/1998 |
| JP | 11-042554 | | 2/1999 |
| JP | 2870537 | | 3/1999 |
| JP | 2000-218513 | | 8/2000 |
| JP | 2000288947 | | 10/2000 |
| JP | 11-216663 | | 12/2000 |
| JP | 2001-77117 | | 3/2001 |
| SU | 1618538 | | 1/1991 |
| WO | WO 93/15879 | | 8/1993 |
| WO | WO 9315879 | A1 * | 8/1993 |
| WO | WO 98/39142 | | 9/1998 |
| WO | WO 98/45090 | | 10/1998 |
| WO | WO 98/49723 | | 11/1998 |
| WO | WO 99/22913 | | 5/1999 |
| WO | WO 99/41434 | | 8/1999 |
| WO | WO 99/53119 | | 10/1999 |
| WO | WO 00/03426 | | 1/2000 |
| WO | WO 00/26443 | | 5/2000 |
| WO | WO 00/33356 | | 6/2000 |
| WO | WO 00/59682 | | 10/2000 |
| WO | WO 00/71297 | | 11/2000 |

OTHER PUBLICATIONS

Partial International Search / PCT Invitation to pay additional fees for PCT/US02/11009 dated Nov. 14, 2002 (4100 PC 02).

Notification regarding review of justification for invitation to pay additional fees for PCT/US/02/11009 (4100 PC 02) dated Feb. 25, 2003.

PCT International Search Report for PCT/US 02/11009 (4100 EP 02) dated Feb. 25, 2003.

PCT Written Opinion dated Apr. 1, 2003 for PCT/US02/11009. (4100 EP 02).

Notification of Transmittal of International Preliminary Examination Report for PCT/US02/11009 dated Nov. 10, 2003 (4100 EP 02).

European Search Report for 03252801.0, dated Jan. 16, 2004 (7047 EP).

Communication pursuant to Article 96(2) EPC for Application NO. 02728965.4, dated Jun. 11, 2004 (4100 EP 02).

Copy of Search Report issued by the Austrian Patent Office for corresponding Singapore Patent Application No. 200302562-4, provided by letter dated Oct. 7, 2004.
Invitation to pay additional fees for PCT/US04/017827 dated Nov. 11, 2004 (4100 P5 PCT).
Notification of Transmittal of International Search Report and Written Opinion for PCT/US04/22722 dated Feb. 21, 2005 (4100 PCT).
Notification of transmittal of the International Search report and Written Opinion for PCT/US04/017827 dated Mar. 14, 2005 (4100 P5 PCT).
PCT International Search Report and Written Opinion dated Apr. 28, 2005 for PCT/US04/037870. (AMAT/4100PC09).

* cited by examiner

FIG. 3A
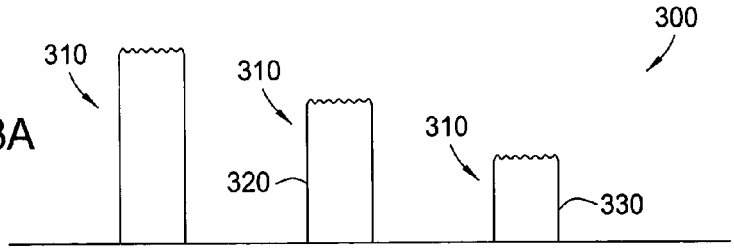
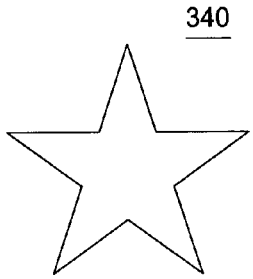
FIG. 3B
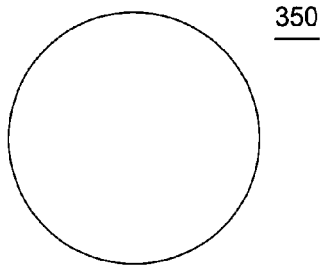
FIG. 3C
FIG. 3D
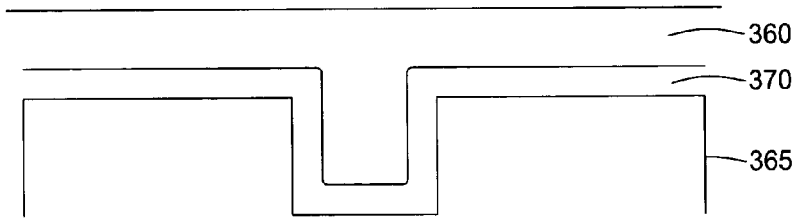
FIG. 3E
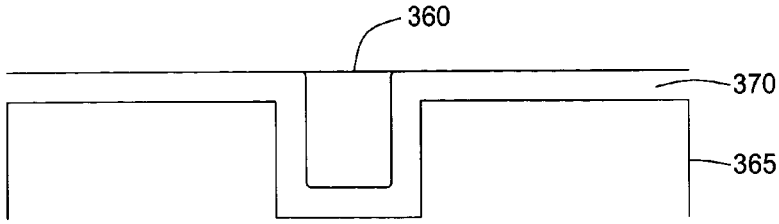

ARTICLE FOR POLISHING SEMICONDUCTOR SUBSTRATES

CROSS-REFERENCE TO RELATED APPLICATIONS

This application is a continuation of U.S. patent application Ser. No. 09/563,628 filed May 2, 2000, now abandoned which claims benefit to U.S. Provisional Patent Application Ser. No. 60,132,175 filed May 3, 1999, which are herein incorporated by reference.

BACKGROUND OF THE INVENTION

1. Field of the Invention

The inventions disclosed herein relate to fixed abrasive articles for chemical mechanical polishing (CMP). The present invention has particular applicability in manufacturing semiconductor devices.

2. Description of the Related Art

Abrasive articles enjoy utility in a variety of industrial applications for abrading, finishing and polishing a variety of surfaces. Typical industrial uses of abrasive articles include polishing a substrate, as during various phases in manufacturing semiconductor devices and magnetic recording media. In manufacturing semiconductor devices, a wafer typically undergoes numerous processing steps, including deposition, patterning and etching. After various processing steps it is necessary to achieve a high level of surface planarity and uniformity to enable accurate photolithographic processing. A conventional planarization technique comprises polishing, as by CMP, wherein a wafer carrier assembly is rotated in contact with a polishing pad in a CMP apparatus. The polishing pad is mounted on a rotating/moving turntable or platen driven by an external driving force. The wafers are typically mounted on a carrier or polishing head which provides a controllable force, i.e., pressure, pressing the wafers against the rotating polishing pad. Thus, the CMP apparatus effects polishing or rubbing movement between the surface of each thin semiconductor wafer and the polishing pad while dispersing a polishing slurry containing abrasive particles in a reactive solution to effect both chemical activity and mechanical activity while applying a force between the wafer and a polishing pad.

Conventional polishing pads employed in abrasive slurry processing typically comprise a grooved porous polymeric surface, such as polyurethane, and the abrasive slurry varied in accordance with the particular material undergoing CMP. Basically, the abrasive slurry is impregnated into the pores of the polymeric surface while the grooves convey the abrasive slurry to the wafer undergoing CMP. A polishing pad for use in CMP slurry processing is disclosed by Krywanczyk et al. in U.S. Pat. No. 5,842,910. Typical CMP is performed not only on a silicon wafer itself, but on various dielectric layers, such as silicon oxide, conductive layers, such as aluminum and copper, or a layer containing both conductive and dielectric materials as in damascene processing.

A distinctly different type of abrasive article from the above-mentioned abrasive slurry-type polishing pad is a fixed abrasive article, e.g., fixed abrasive polishing sheet or pad. Such a fixed abrasive article typically comprises a backing with a plurality of geometric abrasive composite elements adhered thereto. The abrasive elements typically comprise a plurality of abrasive particles in a binder, e.g., a polymeric binder. During CMP employing a fixed abrasive article, the substrate or wafer undergoing CMP wears away the fixed abrasive elements thereby releasing the abrasive particles. Accordingly, during CMP employing a fixed abrasive article, a chemical agent is dispersed to provide the chemical activity, while the mechanical activity is provided by the fixed abrasive elements and abrasive particles released therefrom by abrasion with the substrate undergoing CMP. Thus, such fixed abrasive articles do not require the use of a slurry containing loose abrasive particles and advantageously simplify effluent treatment, reduce the cost of consumables and reduce dishing as compared to polishing pads that require an abrasive slurry. During CMP employing a fixed abrasive polishing pad, a chemical agent is applied to the pad, the agent depending upon the particular material or materials undergoing CMP. However, the chemical agent does not contain abrasive particles as in abrasive slurry-type CMP operations. Fixed abrasive articles are disclosed by Rutherford Et al. in U.S. Pat. No. 5,692,950, Calhoun in U.S. Pat. No. 5,820,450, Haas Et al. in U.S. Pat. No. 5,453,312 and Hibbard Et al. in U.S. Pat. No. 5,454,844, the entire disclosures of which are incorporated by reference herein.

Fixed abrasive elements are typically formed by filling recesses in an embossed carrier with a slurry comprising a plurality of abrasive grains dispersed in a hardening binder precursor and hardening the binder precursor to form individual abrasive composite elements that are laminated to a backing sheet and the embossed carrier removed. The backing sheet containing the individual abrasive composite elements adhered thereto is then typically mounted to a subpad containing a resilient element and a rigid element between the backing sheet and the resilient element Such mounting can be effected by any of various types of laminating techniques, including the use of an adhesive layer. Methods of forming a backing sheet containing fixed abrasive elements are disclosed by Calhoun in U.S. Pat. No. 5,437,754, the entire disclosure of which is incorporated by reference herein, and by Rutherford et al. in U.S. Pat. No. 5,692,950.

Fixed abrasive elements of conventional slurry-less type polishing pads are typically formed in various "positive" geometric configurations, such as a cylindrical, cubical, truncated cylindrical, and truncated pyramidal shapes, as disclosed by Calhoun in U.S. Pat. No. 5,820,450. Conventional fixed abrasive articles also comprise "negative" abrasive elements, such as disclosed by Ravipati et al. in U.S. Pat. No. 5,014,468, the entire disclosure of which is incorporated by reference herein.

During CMP, the surface of conventional polymeric polishing pads for abrasive-slurry type CMP operations becomes glazed thus nonreceptive to accommodating and/or dispensing the abrasive slurry and is otherwise incapable of polishing at a satisfactory rate and uniformity. Accordingly, conventional practices comprise periodically conditioning the pad surface so that it is maintained in a proper form for CMP. Conventional conditioning means comprises a diamond or silicon carbide (SiC) conditioning disk to conditioning the polishing pad. After repeated conditioning operations, the pad is eventually consumed and incapable of polishing at a satisfactory rate and uniformity. At this point, the polishing pad must be replaced. During replacement, the CMP apparatus is unavailable for polishing with an attendant significant decrease in production throughput.

On the other hand, fixed abrasive pads do not undergo the same type of adverse smoothing as do conventional polymeric pads. Moreover, a fixed abrasive pad has a low contact ratio (area of the tops of abrasive elements/total pad area), e.g., about 10% to about 20%, and short abrasive elements. Periodic pad conditioning with conventional CMP apparatus having a rotating round platen. Preconditioning would be expected to adversely affect the polishing rate and uniformity stability, i.e., wafer-to-wafer uniformity, since preconditioning with conventional diamond or SiC disks would be expected to render the pad surface significantly different from that caused by pad-wafer interactions. Accordingly, conventional practices on fixed abrasive pads do not involve preconditioning, i.e., prior to initial CMP, or periodic conditioning, after initial CMP. However, the use of fixed abrasive articles, such as polishing pads, disadvantageously results in poor wafer-to-wafer polishing rate stability on a CMP polisher having a rotating round platen or on a polisher with an advanceable polishing sheet at an indexing rate less than 0.5 to 1.0 inch per minute.

Copending U.S. application Ser. No. 09/244,456 filed Feb. 4, 1999 and assigned to the assignee of the present invention discloses a CMP apparatus having a rotatable platen, a polishing station with a generally linear polishing sheet having an exposed portion extending over a top surface of the platen for polishing the substrate, and a drive mechanism to incrementally advance the polishing sheet in a linear direction across a top surface of the platen. The polishing sheet is releasably seared to the platen to rotate with the platen, and it has a width greater than the diameter of the substrate. Thus, an unused portion of the polishing sheet is incrementally advanced or indexed after polishing a wafer, e.g., by exposing about 0.5 inch to about 1 inch per minute of virgin or unused polishing pad surface. In this way, wafer-to-wafer rate stability is improved. The entire disclosure of U.S. application Ser. No. 09/244,456 is hereby incorporated by reference herein. However, indexing of 0.5 to 1 inch per minute of pad significantly reduces the useful life of fixed abrasive polishing sheets, condemning them to the trash bin before the abrasive elements are consumed to any significant extent, thereby significantly increasing manufacturing costs.

Copending U.S. patent application Ser. No. 09/244,456 filed Feb. 4, 1999, now U.S. Pat. No. 6,244,935 issued on Jun. 12, 2001, and Continuation-In-Part of that patent application Ser. No. 09/302570 filed on Apr. 30, 1999, now U.S. Pat. No. 6,475,078 issued on Nov. 5, 2002, each of which is assigned to the Assignee of the present invention, disclose a CMP polishing apparatus wherein polishing sheets, e.g., polishing sheets containing fixed abrasive elements, are moved in a linear direction during CMP. The entire disclosures of U.S. patent application Ser. No. 09/244,456 now U.S. Pat. No. 6,244,935 and of U.S. patent application Ser. No. 09/302570 now U.S. Pat. No. 6,475,078 are incorporated herein by reference.

There exists a need to extend the useful life of a fixed abrasive article, e.g., polishing sheet or pad, while simultaneously maintaining high wafer-to-wafer rate stability. There also exists a need for a CMP apparatus enabling the use of fixed abrasive polishing pads having an extended life and achieving high wafer-to-wafer rate stability. There also exists a need for fixed abrasive articles, methods of manufacturing fixed abrasive articles, CMP apparatus employing fixed abrasive articles and CMP methods utilizing fixed abrasive articles which: enable a reduction in contamination during CMP; improving CMP as by facilitating web removal; avoid the formation of air bubbles under a fixed abrasive web; facilitate application of chemicals during CMP; tailoring a fixed abrasive article for use in a variety of substrate materials; reduce and/or eliminating indexing; dissipating heat during CMP; improve conformance of the polishing web during CMP; condition a fixed abrasive element; increase the amount of web material stored on a roll; monitor CMP; optimize the use of chemicals during CMP; optimize controlling CMP temperature; tailor the chemical agent during CMP; reduce particulates in the CMP effluent; detect and analyze effluent particles to determine their composition; control the particles in the effluent to reduce scratching and dishing; determine the useful lifetime of fixed abrasive elements during CMP; optimize the lifetime of a fixed abrasive web; optimize indexing; and generally improve the efficiency, increasing manufacturing throughput and reducing cost of CMP.

SUMMARY OF THE INVENTIONS

In one aspect the invention provides an article for polishing semiconductor substrates comprising a conductive material disposed in a binder.

In another aspect the invention provides an article for polishing a semiconductor substrate comprising graphite particles disposed in a polymeric binder.

In another aspect the invention provides an article for polishing a semiconductor substrate comprising graphite filaments disposed in a polymeric binder.

In another aspect the invention provides an article for polishing a semiconductor substrate comprising graphite rods disposed in a polymeric binder.

In another aspect the invention provides an article for polishing a semiconductor substrate comprising tin or lead particles disposed in a polymeric binder.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3A illustrates an embodiment of posts of different heights.

FIG. 3B and FIG. 3C show two embodiments of shaped posts.

FIG. 3D and FIG. 3E are embodiments illustrating the eventual exposure of copper and a barrier layer of Tantalum (Ta) after CMP.

DETAILED DESCRIPTION OF THE PREFERRED EMBODIMENT

The inventions disclosed and claimed herein address and solve the foregoing problems thereby improving the efficiency and reducing the cost of CMP while maintaining improved wafer-to-wafer uniformity and, generally improving the quality of semiconductor devices. The inventions set forth herein are illustrated by the embodiments set forth hereinafter.

EMBODIMENT NO. 1

The inventive concept resides in providing a permeable web 110 to introduce chemicals, e.g., a microporous web. Advantages further include preventing air bubbles under the web. The web material itself is permeable to the supply chemicals.

A problem which arises during CMP is effective supplying chemicals underneath the wafer resulting in starvation at the wafer center. This would apply to both fixed abrasive and conventional slurry CMP. As the wafer rotates, a leading edge-trailing edge situation arises. But in any case, around the edge of the wafer at some point all of the different points on the edge get to be leading at some point and all of them get to be trailing at some point, but the center is always the center. The leading edge chemical concentrations are greater than the trailing edge chemical concentrations. There may be some depletion across the wafer during rotation and the wafer is rotating around the center of the wafer. Thus, the center of the wafer always experiences some medium chemical concentration. Accordingly, the chemical concentration is going up and down and up and down causing a very unstable situation. This problem is solved by providing a permeable abrasive pad so that the wafer sees a uniform concentration of chemicals everywhere. The web 110 is permeable in a vertical direction, coming up from the bottom 120. The chemicals would be supplied through the platen not shown itself up directly through the membrane.

Figure 1:
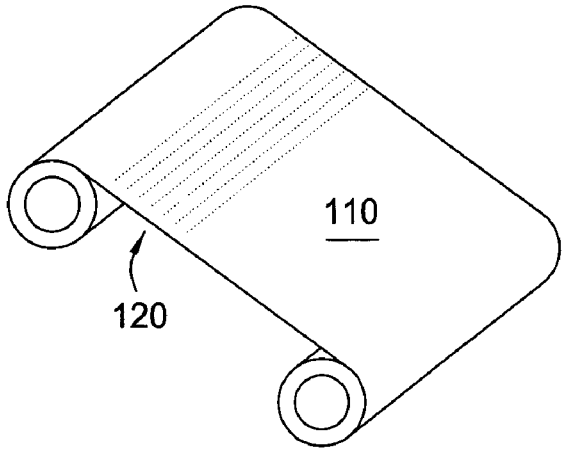
FIG. 1 is an embodiment of a permeable web.

Another advantage is that if air bubbles are trapped, by providing a non-flat surface to the abrasive, it would permeate out. The bottom 120 is shown in FIG. 1.

This arrangement is not incompatible with vacuum hold down, because by sucking it through a semipermeable membrane a pressure drop across the membrane occurs and this is what provides the necessary hold down, also referred to as conductance.

Aspects include patterns of vacuum channels on one part and chemical supply channels on another part. The vacuum hold down is, therefore, dispersed evenly enough to get a good hold down on a film without localized tearing. The chemistry supply would go up through the film with proper spacing of the air and chemical supply channels.

EMBODIMENT NO. 2

Figure 2:
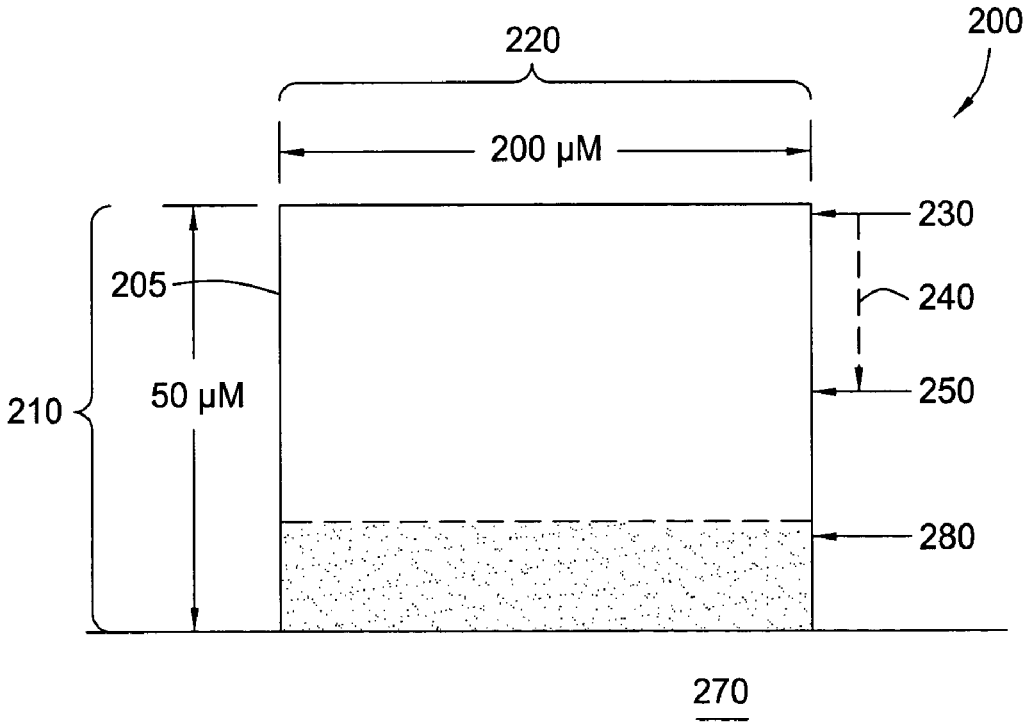
FIG. 2 is an embodiment of a post of abrasive material displayed on backing material.

This invention entails impregnating the plastic matrix of a web 200 with process chemicals. FIG. 2, depicts a post 205 of abrasive material. Such posts are typically about 50 microns tall 210 and about 200 microns in diameter 220. But the shape of it in no way limits the invention. During polishing, the first wafer is at the top 230 of the post 205, which wears down 240 so that later wafers are exposed to a lower part 250 of the post 205.

There are a number of different functions performed by the CMP chemistry, e.g., oxidizers, inhibitors, such as corrosion inhibitors, buffers, and chelating agents. Ergo, there are a number of different roles performed that vary somewhat, depending on the particular system, e.g., copper, tungsten or oxide. However, the concept of chemical impregnation would be the same.

For illustrative purposes, in a Cu system, the oxidizers attack the copper and oxidize it to get copper oxide. That performs two functions. Initially, a corrosion barrier is provided where there is no abrasion—it is self limiting where rubbing does not occur. Therefore, etching stops. But in the high spots the oxide is more prone to polish than the copper metal. Therefore, the oxide is polished and then reoxidized, polished, and then reoxided. The oxide is not a good enough barrier in the low spots, and that is why some corrosion inhibitors, e.g., BTA, are included to basically assist the oxidizer in capping the surface in the low spots where not undergoing polishing. The mechanical action of polishing on the high spots removes both the oxide layer and the inhibitor so that it initiates a fresh attack of the copper. Chemical buffers are employed to maintain the pH in the solution because these chemicals are pH active—it is an electrochemical type of a process which is dependent on pH. Chelating agents take the copper in the solution and maintain it in solution so that the material rubbed off is removed instead of redepositing on the wafer.

It is particularly advantageous to impregnate a buffer into the plastic matrix to maintain a desired pH. The buffer impregnated in the plastic matrix is continually supplied at the exact point needed—right at the point of polishing. Thus, any of the types of chemicals could be supplied into the posts, e.g., buffers, oxidizers, inhibitors, etc.

There are several advantages of putting the chemicals into the posts 205. One is that it provides a timed release. As the post 205 wears down, more and more chemical is provided in a very controlled manner.

The pad 200 refers to the squishy stuff supplied as a backing 270 either integral or nonintegral with the web material itself, which is the backing film that carries the posts 205 and the posts 205 themselves. From a very minimalistic standpoint, the web is the posts 205 and the backing 270. For the web, as in going reel to reel, it is just the backing 270 and the posts 205, and the squishy subpads are supplied independently. It is the posts 205 themselves that are in contact with the wafer. Thus, as the posts 205 wear down fresh chemicals are continually exposed for timed release, thereby obtaining a more constant concentration over time right at the point of contact where it is desired.

Moreover, web manufacturers can determine how much chemicals to include, which is more controllable than depending on a technician to refurbish chemicals, since it is always going to be the same concentration depending on your manufacturability position, rather than what is going on in the field or if the equipment is breaking down.

Another aspect comprises introducing a chemical marker 280 down near the bottom of the posts 205 that is inert to the process but detectable, thereby providing a signal when approaching the end of the posts 205. Such chemicals can include an organic dye, that would not adversely interact with the process chemistry. When it starts getting released it would be very obvious to the eye because of a color change. In addition, optical detectors can be installed in the effluent stream. Another aspect of this embodiment comprises detecting a drift in process uniformity from first wafer to a subsequent wafer, and correcting the drift by suitable chemistry in the posts.

EMBODIMENT NO. 3

This embodiment involves forming a fixed abrasive web 300 with a plurality of posts 310 having different shapes, different sizes, different heights, different materials and having different distributions of particles. This provides the ability to tailor a web 300 for different functions, for example, simultaneous CMP of metal and oxide.

This embodiment solves the problem of process drift over time by tailoring a number of posts 310 in contact over time so that when some of them wear down, the wafer starts engaging more and more posts 310. Another problem stems from a rate difference between initial contact of the posts 310 and subsequent post contact after some CMP. The first contact with lower posts 320 and 330 would experience a different rate.

FIG. 3B and FIG. 3C, shows examples of two different shapes 340 and 350. By combining the different shapes on the web the benefits of the different shapes are achieved.

Later on in the process, copper 360, for example, begins to clear over oxide 365 and a barrier layer of Tantalum (Ta) 370 is exposed as shown in FIG. 3E. The Ta must also be removed stopping on the oxide 365. This aspect involves tailoring the selectivity, whereas, conventionally, the web 300 is very selective to both Ta and oxide, e.g., about 500 to 1 on Ta and about 250 to 1 on oxide. Aspects of this embodiment include a web 300 with a selectivity of 1 to 1 to 1, as by strategically formulating the posts with suitable chemistry for targeted etching.

Varying the shape, height and diameter of the posts to obtain different structures or patterns can be easily implemented. Smaller posts 320 and 330 have a better removal rate and faster abrasion, because the smaller ones have the ability to dig better.

EMBODIMENT NO. 4

Figure 4A:
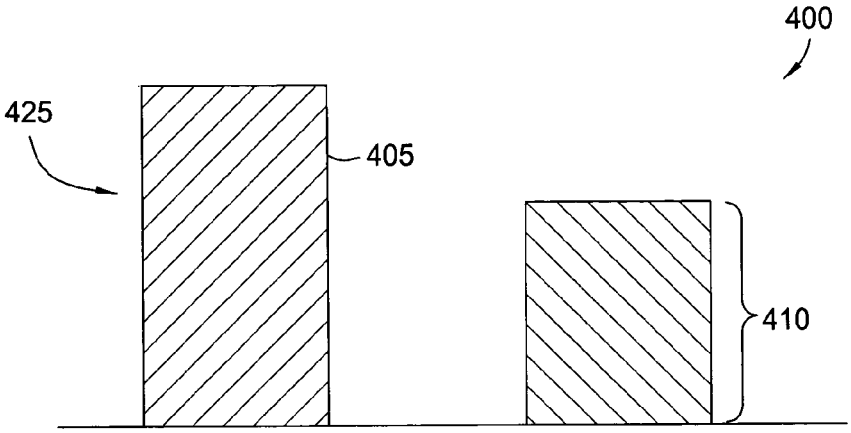
FIG. 4A and FIG. 4B are embodiments illustrating the concepts of compressibility with a wafer having a high part and a low part.
Figure 4B:
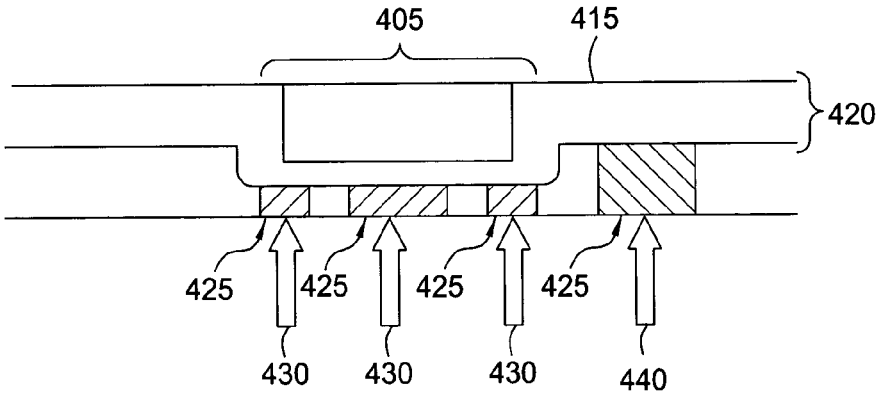

This invention includes the concept of varying the compressibility of the web 400 to obtain non-linear compressibility to effectively treat both high and low spots on a wafer. Under compression, the modulus of compressibility would increase significantly as the material 405 is compressed to about 50% 410, as with common sealant elastomers that are loaded with a silica filler to provide strength and body. As the squishy sealant is compressed, the polymer compresses, but upon filler to filler contact, compression ceases completely, i.e., a very non-linear compressibility. In this embodiment, a post is provided so that when a force is applied, it can compress a certain amount, but then further force doesn't compress it any further, i.e., a non-linear spring. As illustrated in FIG. 4B, with a wafer 420 having a high part 405 and a low part 415, the high part 405 contacts the post 425 and compress it to obtain a large force 430. Where they are in contact with the low parts 415, a weak force 440 is obtained. By providing a non-linear force, part of the wafer 420 protrudes a number of microns beyond a low spot 415 and compresses a post 425 to a greater extent making it even stiffer so that it pushes back harder. The modulus of compressibility of the post 425 can be changed by suitable crosslinking in the polymer, varying the amount of filler, or changing the nature of the polymer, e.g., a more linear polymer or a more trifunctional or even a quadrifunctional polymer. This is well known art in the polymer industry.

The inventive concept is that, as the wafer 420 is pressed down, in the limit, only the high points 405 on the wafer will automatically contact the pad 400 for polishing. Each post 425 will vary in its modulus of compressibility depending on the amount of force applied to it. Thus, each post 425 is similar to a little spring and the frictional force varies with the applied force. In a linear spring, the force is relatively constant with displacement. However, with non-linear springs, as in this embodiment, if sufficient pressure is applied, the force dramatically increases, thereby automatically applying greater force 430 to the high spots 405 on a wafer 420 vis-a-vis low spots 415.

EMBODIMENT NO. 5

Advantageously, a fixed abrasive polishing web comprising a heat dissipating material can overcome the problems associated with excess heat build-up during polishing. In an aspect of this embodiment, the heat dissipating substance is incorporated into the posts and/or associated backing sheet. Thermally conductive materials include a metal powder, e.g., iron, nickel, copper, zinc, tin, lead, silver, gold, titanium, tungsten, palladium, bismuth, indium, gallium, aluminum and alloys thereof; metallized polymers or metallized ceramics such as alumina, silica, glass, polyamide, polystyrene, polyetheramide, polyacetylene, polyphenylene, polyphenylene sulfide, polypyrol, polythiophene, and graphite. The conductive elements may be provided in many forms, such as for example, particles, wires, filaments, and metallized flakes. The elements may have a wide variety of regular and irregular shapes, as for example, spheres, rods, flakes, and filaments. The binder can be a thermoplastic or a thermo- setting-type polymer or a monomer which will polymerize to form the thermally conducted substrate having the thermally conducted element therein.

EMBODIMENT NO. 6

Figure 5A:
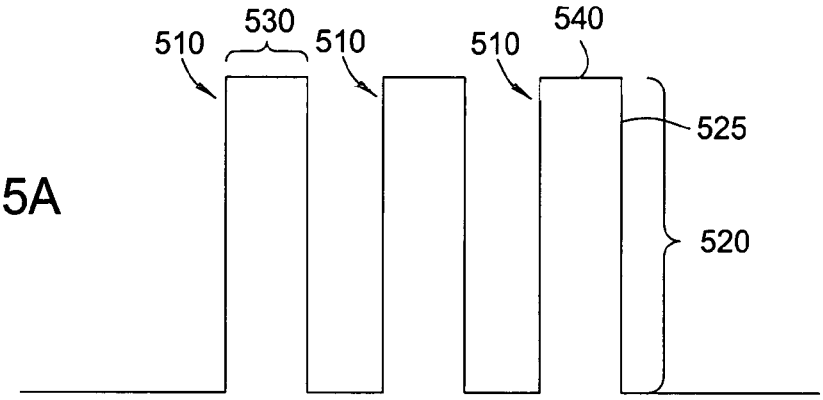
FIG. 5A and FIG. 5B shows embodiments of very tall posts that lean over like bristles ad polish on their sides during CMP.
Figure 5B:
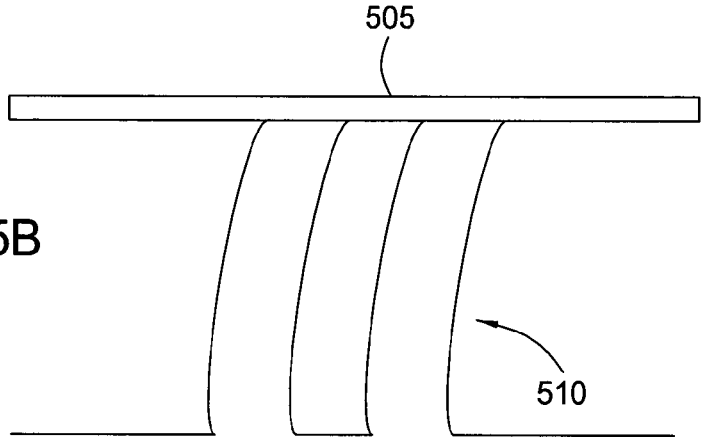
Figure 5C:
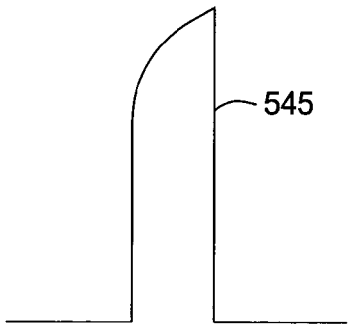
FIG. 5C and FIG. 5D illustrate additional embodiments of the individual posts having a sloped one directional (1-D) side 545 and having a rounded direction averaged side 550.
Figure 5D:
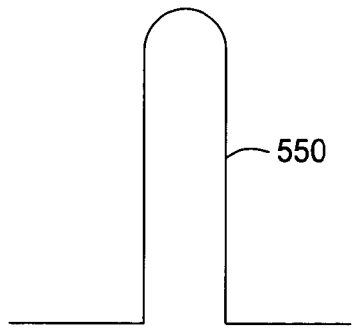

This embodiment relates to a fixed abrasive web comprising a plurality of elongated posts on a sheet. Conventional posts have a diameter of about 125 to 1,000 microns, with the diameter about twice the height. Accordingly, conventional posts extend up to 500 microns above the backing sheet. The present embodiment comprises forming posts 510 with a ratio of the height 520 to diameter 530 opposite conventional practices, so that the posts 510 are significantly higher than their diameter 530. In this way, a multiplicity of very tall posts 510 are formed, as shown in FIG. 5. Instead of polishing on their upper edges 540, these tall posts 510 lean over like bristles and polish on their sides 525 that wear off during CMP. Thus, the tall posts 510 are formed so that they lean over during CMP of a substrate 505 and flow brushing from the side and round off at the top as shown in FIG. 5B. FIG. 5C and FIG. 5D illustrate additional embodiments of the individual posts having a sloped one directional (1-D) side 545 and having a rounded direction averaged side 550.

Advantageously, according to this embodiment, only a small amount of force is required to bend over the individual posts. However, the force would increase as the taller posts bend to contact each other any are stacked upon each other side by aide. At this point, the down force gets compressed. Aspects of this embodiment include forming posts 510 having a height 520 of about one micron to about ten microns and paced apart about one micron to about ten microns.

EMBODIMENT NO. 7

Figure 6:
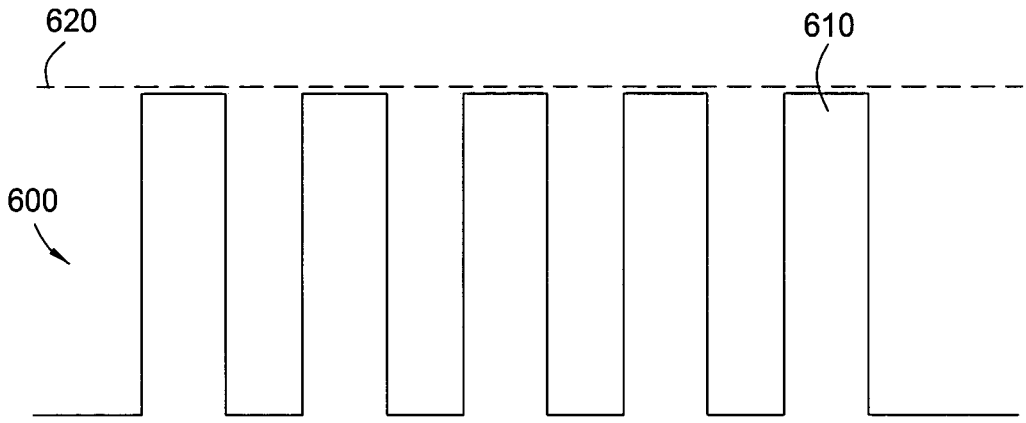
FIG. 6 is an embodiments showing preconditioned posts having equal heights above the backing.

This embodiment comprises preconditioning fixed abrasive articles 600 comprising a plurality of posts 610 so that the posts have equal heights 620 above the backing to achieve a uniform texture, i.e., uniform abrasive surface on the posts as shown in FIG. 6. In this way, each post has exactly the same top surface, i.e. uniform surfaces and uniform heights. This objective can be implemented by physical dressing, as by an abrasive material which is harder than the abrasive material of the posts, pre-seeding with a slurry including polishing debris. By pre-seeding employing polishing debris, the first wafer effect is eliminated. The first wafer effect is conventionally encountered and involves initial non-uniformity with the initial wafer. It is believed that subsequent wafers are polished in the presence of polishing debris. Accordingly, by pre-seeding with polishing debris, the first wafer effect is eliminated.

Another aspect of the present invention comprises the use of a laser to precondition the posts 610.

EMBODIMENT NO. 8

Figure 7A:
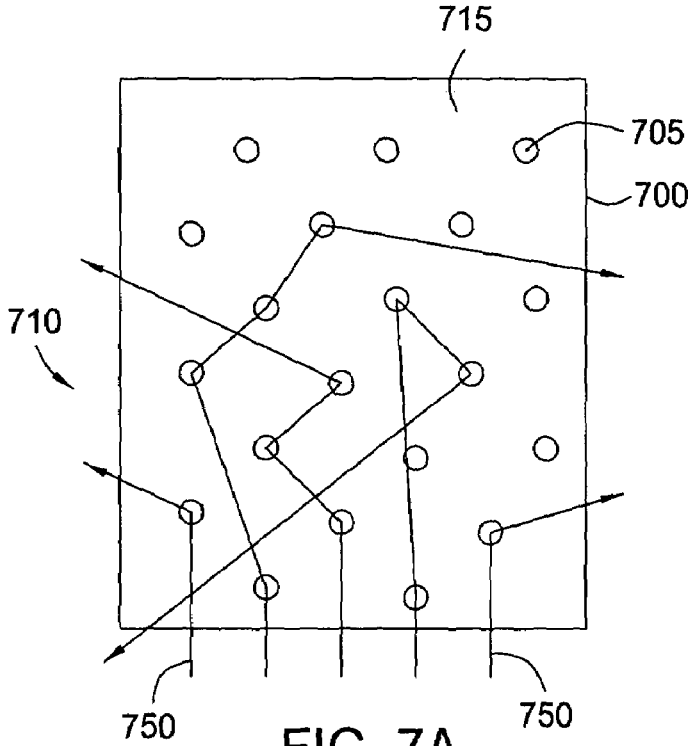
FIG. 7A is an embodiment of a web material that scatters light when the refractory index of the polymer matrix does not match the refractory index of the abrasive particles.
Figure 7B:
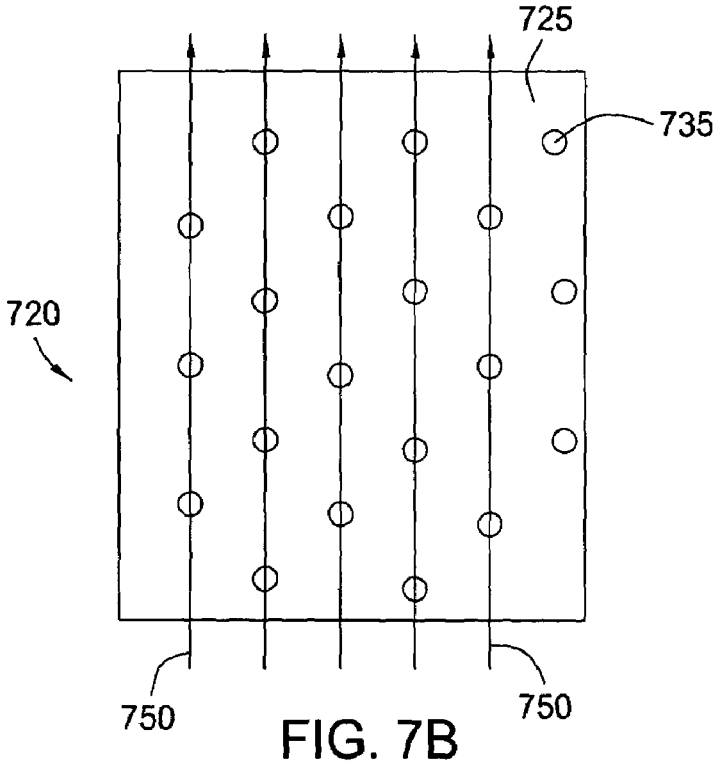
FIG. 7B is an embodiment of a web material that does not scatter light since the refractory index of the polymer matrix matches that of the abrasive particles.

This invention relates to improvements with respect to in situ rate measurement (ISRM) devices. The ISRM device is a laser base device that shines a light 750 though the web material 700 to provide a measurement of film thickness. The web material 700 is a composite of abrasive particles 705 and a polymer binder 715. The dispersed particles typically have a different refractive index than the matrix 725 thereby resulting in scattering 710. It is therefore, very difficult to get the laser through with detectable intensity, particularly since it has to make the trip twice, (i.e.) it has to go in reflect and come back out. This embodiment solves that problem changing the refractory index of the polymer matrix 725 to match that of the abrasive particles 735. The refractory of the polymers can easily be adjusted to match it to about that of the refractory index to obtain totally clear material 720. See FIG. 7.

Embodiments of the present invention include abrasive particles 735 and binders 725 made of a laser light transparent material. For example, both abrasive particles 735 and the binder 725 can be made of a transparent polymer, e.g., a polyurethane, a polycarbonate, an epoxy resin; inorganic minerals, e.g., sapphire, glass, quartz; or hard organic or semi-organic materials, e.g., diamond or germanium.

EMBODIMENT NO. 9

Figure 8A:
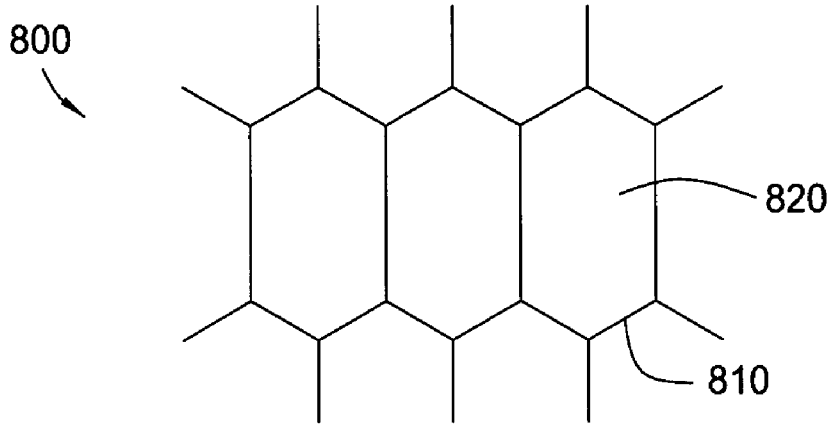
FIG. 8A shows an embodiment of a walled off region forming a hexagonal recess which is isolated, such that the posts constitute walls around these isolated recesses.
Figure 8B:
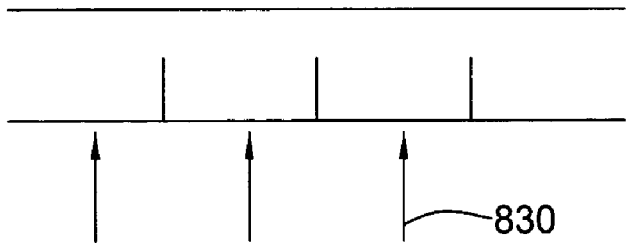
FIG. 8B is an embodiment of a number of different little cells, each cell a pocket.

The invention resides in forming a fixed abrasive web with negative posts, as in U.S. Pat. No. 5,014,468 and incorporating chemicals in the negative recesses. Typically, the posts form about 10–25 percent of the surface of the pad, leaving at least about 75% as open channel, i.e., a connected phase employing terminology from percolation theory. The connected phase is the one connected all the way through. The open space is the connected phase; the posts are disconnected from one another. This embodiment reverses the conventional fixed abrasive pad by making the open space the disconnected phase and making the posts the connected phase, thereby maintaining the same relative amount of post area. However, a region can be walled off or damned, as by forming a hexagonal recess 820 which is isolated, such that the posts 810 constitute walls around these isolated recesses 820. In the process of contacting the web 800 and the wafer, the chemicals are supplied in these recesses 820. The chemicals are primarily liquid and the concern with the posts 810 where the open spaces, the connected phases, is that the liquid can mix around and go around. If the chemicals are supplied in these isolated recesses, then the chemicals are going to be transported with the web 800 and remain in one place. Therefore, the chemistry is basically isolated through a number of different little cells, each cell a pocket 830. A circuitous or tortuous path can be formed between the posts so that you're not totally isolated, but effectively isolated. See FIGS. 8A and 8B.

EMBODIMENT NO. 10

Figure 9:
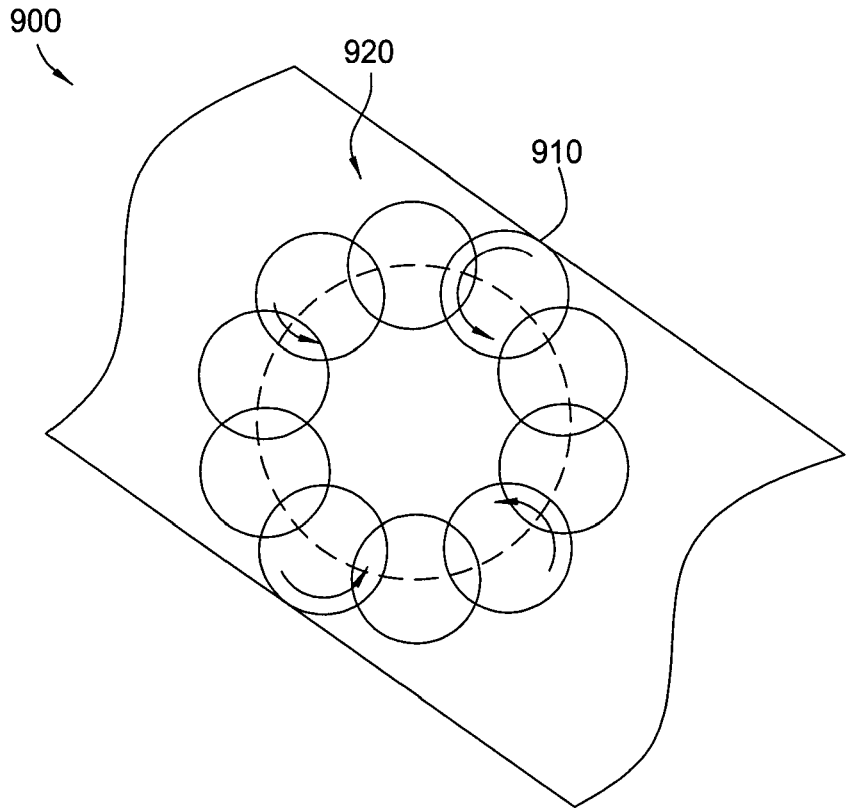
FIG. 9 illustrates an embodiment of round/round polishing when the wafer travels around in a circle on the web material.

This embodiment resides in proving a non-homogenous web 900 with different areas to perform different functions, thereby providing greater flexibility. For example, posts can be used to perform buffing. This embodiment provides macroscopic regions of the web which are different for different functions. For example, one area of the web can be for copper polish and another area for example, would remove Ta, thereby achieving a macroscopic effect. This can be easily implemented in round/round polishing when the wafer 910 travels around in a circle on the web material 920, and it rotates in its place. See FIG. 9.

The wafer 910 effectively describes a circle around on the web material 920 and, therefore, the track of the center is at a uniform distance in a circular path around on the web. However, the edges sometimes extend further out and sometimes further in, because they are also rotating as the wafer 910 goes around. Accordingly, polishing is enhanced, as, for example, at the center, versus the edge, by introducing a strip of material where the center would spend more time over that strip. The concept includes altering the behavioral performance of the web in different regions, in macroscopic regions, to alter performance of for example, under the edge on the wafer 910.

EMBODIMENT NO. 11

The problem addressed by the present invention is that the conventional web backing material, i.e., believed to be a polyester-based material, sheds on abrasion. Frictional interaction between the platen and the web during advancement generates particles in the process. The solution to this problem resides providing a non-shedding backing material, such as a self-lubricating plastic. Such self-lubricating plastics are conventional.

Examples of self-lubricating polymers include fluorinated alkane, e.g., teflon, fluorinated polyethers. fluorinated polyesters, polyether ketones, e.g., PEEK, nylons, or acetal resins. Examples of self-lubricating polymeric compositions include a resin component and from about 30 wt. % to about 0.5 wt. % of a lubricating system. Resin components useful in the polymeric composition can be selected from polyamides, polyesters, polyphenylene sulfides, polyolefins, polyoxymethylenes, styrene polymers, and polycarbonates. The lubricating system of the present invention can be characterized as containing a lubricating amount, sufficient to reduce friction and wear, of the resin component and can include polytetrafluorethylene, stearates, and calcium carbonates. Many other materials, including solid lubricants and fibers, e.g., graphite, mica, silica, talc, boron nitride and molybdenum sulfide, paraffin waxes, petroleum and synthetic lubricating oils, and other polymers, e.g., polyethylene and polytetrafluorethylene, can be added to the resin component to improve friction properties.

EMBODIMENT NO. 12

Figure 10:
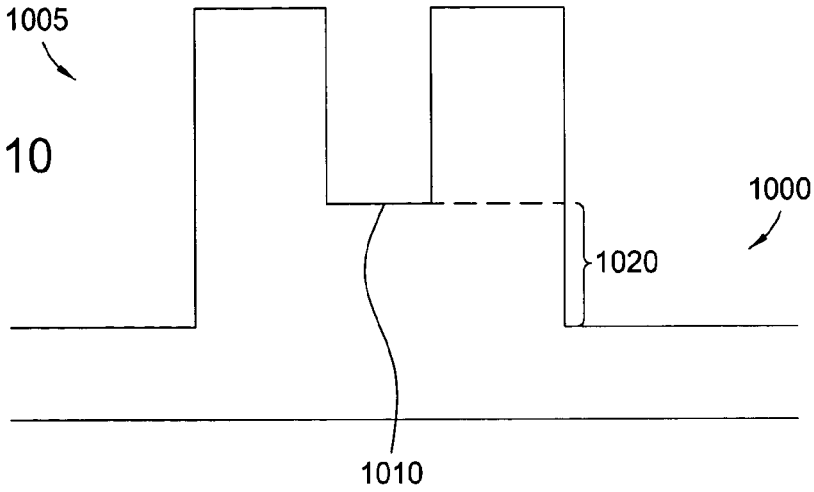
FIG. 10 is an embodiment of a safety technique to determine when the posts are consumed.

This invention provides a safety technique to determine when the posts are consumed. Embodiments include incorporating a tracer component, such as an inert chemical, to provide a warning as to the number of wafers capable of being polished by the partially consumed web 1000. In another aspect, a notch or a bar 1110 is provided for a mechanical indication. See FIG. 10.

Some indicators are higher than the surrounding, to indicate the end of the CMP process. When the indicator or bar 1010 is reached, only a certain amount of height 1020 remains. This can be detected by visually inspecting or by physically sensing the height to determine when the heights of the post 1005 and wear bar 1010 are equal.

EMBODIMENT NO. 13

Figure 11A:
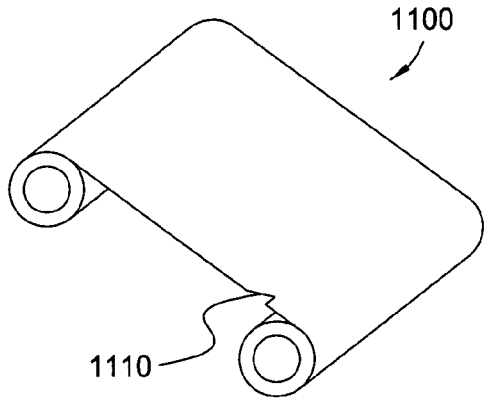
FIG. 11A and FIG. 11B are embodiments of mechanical indications of when the post has been consumed.
Figure 11B:
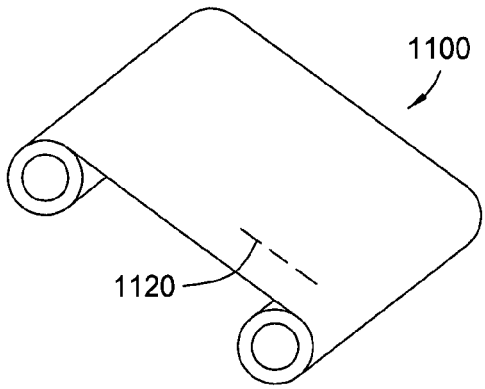

This invention resides in providing a mechanical means, such as a notch 1110, to determine when approaching the end of the abrasive web roll 1110. See FIG. 11A. When advancing the web 1100, it is advantageous to know when the end is approaching to avoid running out of roll 1100. A notch 1110 is provided which can be detected either mechanically or optically, similar to the dots that flash to indicate to a projectionist in the movie theater that the end of a reel is approaching, or the prink stripe 1120 in cash register receipts as shown in FIG. 11B, preferably, on the web back to avoid impacting the process.

EMBODIMENT NO. 14

The invention resides in coding the web throughout its length to enable determining the location of different portions of the web. Bar codes or a number readable with optical character recognition can be used. Little holes can be punched through to provide a detectable pattern. Any type of encoding along the length of the web can be provided and read with an appropriate type of sensor. The inventive concept involves encoding the location along the length of the web. There are at least two benefits. One is real time feedback and any kind of motion control. For example, the length of a moving web is determined with feed back control to activate a command signal to advance the web. A second benefit is that the amount of web advanced can be read. This enables: (1) good tracking of wafers polished to location on web; and (2) determination of the proximity to the end of the web and alarm for an operator to replace the web.

EMBODIMENT NO. 15

A thin monolayer, e.g., one millimeter, of diamond is formed on the web posts containing silicon carbide particles, and chemical preconditioned to remove about 500 Å of matrix from the top of the posts to expose the diamonds, as by chemical preconditioning using heat or solvent to selectively remove the matrix.

This embodiment advantageously prolongs the wear rate of the web through the use of superabrasive, a term used in the industry for a very hard material, e.g., diamond, or cubic boronitride. The wear rate of the posts are reduced to the extent that they don't change appreciatively over time, thereby improving CMP uniformity.

EMBODIMENT 16

This invention resides in providing perforations in the sides or end of the web for improved handling. Rolls can be provided with sprockets to engage the perforations.

The present invention is applicable to all types of fixed abrasive articles, including rotating polishing pads that are substantially circular and substantially rectangular polishing sheets. The present invention provides wafer-to-wafer rate stability for CMP and can be employed during various phases of semiconductor device manufacturing. The present invention, therefore, enjoys utility in various industrial applications, particularly in CMP in the semiconductor industry as well as the magnetic recording media industry.

Only the preferred embodiments of the present invention and but a few examples of its versatility are shown and described in the present disclosure. It is to be understood that the present invention is capable of use in various other combinations and environments and is capable of changes and modifications within the scope of the inventive concept as expressed herein.

While the foregoing is directed to embodiments of the present invention, other and further embodiments of the invention may be devised without departing from the basic scope thereof, and the scope thereof is determined by the claims that follow.

What is claimed is:

1. An article for polishing semiconductor substrates, comprising:

a backing; and a conductive polishing layer disposed on the backing, the polishing layer comprising a conductive material disposed in a binder and having a predefined pattern of one or more interstitial spaces formed in the polishing layer, wherein the binder comprises a thermoplastic or thermosetting-type polymer.

2. The article of claim 1, wherein the conductive material comprises at least one of iron, nickel, copper, zinc, tin, lead, silver, gold, tungsten, titanium, palladium, bismuth, iridium, gallium, aluminum, or alloys thereof.

3. The article of claim 1, wherein the predefined pattern of interstitial spaces comprises a plurality of pockets formed in the polishing layer.

4. The article of claim 1, wherein the predefined pattern of interstitial spaces comprises a plurality of channels formed in the polishing layer.

5. The article of claim 1, wherein the predefined pattern of interstitial spaces comprises a plurality of flow paths formed in the polishing layer.

6. An article for polishing semiconductor substrates, comprising:

a backing; and a conductive polishing layer disposed on the backing, the polishing layer comprising a conductive material disposed in a binder and having a predefined pattern of one or more interstitial spaces formed in the polishing layer, wherein the conductive material comprises at least one of a metal powder, metallized polymers, metallized ceramics, or graphite.

7. An article for polishing semiconductor substrates, comprising:

a backing; and a conductive polishing layer disposed on the backing, the polishing layer comprising a conductive material disposed in a binder and having a predefined pattern of one or more interstitial spaces formed in the polishing layer, wherein the conductive material comprises conductive elements selected from at least one of particles, wires, filaments, or metallized flakes.

8. The article of claim 7, wherein the conductive material is a conductive element in the shape selected from at least one of spheres, rods, flakes, or filaments.

9. An article for polishing semiconductor substrates, comprising:

a backing; and a conductive polishing layer disposed on the backing, the polishing layer comprising a conductive material disposed in a binder and having a predefined pattern of one or more interstitial spaces formed in the polishing layer, wherein the conductive material further defines a plurality of posts extending from the backing.

10. An article for polishing semiconductor substrates, comprising:

a backing; and a conductive polishing layer disposed on the backing, the polishing layer comprising a graphite disposed in a binder and having a predefined pattern of one or more interstitial spaces formed in the polishing layer.

11. The article of claim 10, wherein the conductive material further comprises graphite particles disposed in the binder; and wherein the binder is polymeric.

12. The article of claim 10, wherein the graphite further comprises graphite filaments disposed in the binder; and wherein the binder is polymeric.

13. The article of claim 10, wherein the graphite further comprises graphite rods disposed in the binder; and wherein the binder is polymeric.

14. An article for polishing semiconductor substrates, comprising:

a backing; and a conductive polishing layer disposed on the backing, the polishing layer comprising a conductive material disposed in a binder and having a predefined pattern of one or more interstitial spaces formed in the polishing layer, wherein the conductive material further comprises at least one of tin or lead particles disposed in the binder; and wherein the binder is polymeric.

15. An article for polishing semiconductor substrates, comprising:

a backing; and a plurality of conductive protrusions disposed on the backing and having a predetermined pattern of interstitial spaces disposed therebetween, the conductive protrusions comprising a conductive material disposed in a binder and wherein an upper surface of the conductive protrusions define a polishing surface.

16. The article of claim 15, wherein the conductive material comprises at least one of a metal powder, metallized polymers, metallized ceramics, or graphite.

17. The article of claim 15, wherein the conductive material comprises at least one of iron, nickel, copper, zinc, tin, lead, silver, gold, tungsten, titanium, palladium, bismuth, iridium, gallium, aluminum, or alloys thereof.

18. The article of claim 15, wherein the binder comprises a thermoplastic or thermosetting-type polymer.

19. The article of claim 15, wherein the conductive material comprises at least one of conductive particles, wires, filaments, or metallized flakes.

20. The article of claim 15, wherein the conductive material is in the shape selected from at least one of spheres, rods, flakes, or filaments.

21. The article of claim 15, wherein the conductive material is graphite.

22. The article of claim 15, wherein the conductive material further comprises graphite particles disposed in the binder; and wherein the binder is polymeric.

23. The article of claim 15, wherein the conductive material further comprises graphite filaments disposed in the binder; and wherein the binder is polymeric.

24. The article of claim 15, wherein the conductive material further comprises graphite rods disposed in the binder; and wherein the binder is polymeric.

25. The article of claim 15, wherein the conductive material further comprises at least one of tin or lead particles disposed in the binder; and wherein the binder is polymeric.

26. The article of claim 15, wherein the conductive protrusions further comprise a plurality of posts extending from the backing, the posts having a plurality of gaps disposed therebetween.

27. The article of claim 15, wherein the predetermined pattern of interstitial spaces comprises a plurality of pockets formed in the polishing layer.

28. The article of claim 15, wherein the predetermined pattern of interstitial spaces comprises a plurality of channels formed in the polishing layer.

29. The article of claim 15, wherein the predetermined pattern of interstitial spaces comprises a plurality of flow paths formed in the polishing layer.

30. An article for polishing semiconductor substrates, comprising:

a backing;

a conductive polishing surface disposed on the backing and comprising conductive material disposed in a binder; and a plurality of interstitial spaces formed in the polishing surface in a predetermined arrangement, wherein the predetermined arrangement of interstitial spaces comprises a plurality of flow paths formed in the polishing layer.

31. The article of claim 30, wherein the predetermined arrangement of interstitial spaces comprises a plurality of pockets formed in the polishing layer.

32. The article of claim 30, wherein the predetermined arrangement of interstitial spaces comprises a plurality of channels formed in the polishing layer.

* * * * *

UNITED STATES PATENT AND TRADEMARK OFFICE

CERTIFICATE OF CORRECTION

PATENT NO. : 7,014,538 B2
APPLICATION NO. : 10/382079
DATED : March 21, 2006
INVENTOR(S) : James V. Tietz et al.

It is certified that error appears in the above-identified patent and that said Letters Patent is hereby corrected as shown below:

Column 1, Line 10: Change “60,132,175” to --60/132,175--

Column 2, Line 30: Insert a period after “element”

Column 4, Line 55: Change “ad” to --and--

Column 9, Line 3: Change “aide” to --side--

Column 10, Line 4: Change “damned” to --dammed--

Column 10, Line 56: Change the period after “polyethers” to a comma

Column 11, Line 28: After “roll”, change “1110” to --1100--

Column 11, Line 34: Change “prink” to --pink--

Signed and Sealed this

Fourteenth Day of November, 2006

JON W. DUDAS
*Director of the United States Patent and Trademark Office*